United States Patent [19]
Kirkhuff
[11] 4,065,899
[45] Jan. 3, 1978

[54] INTERLOCKING COMBINATION SHINGLE AND SHEETING ARRANGEMENT

[76] Inventor: William J. Kirkhuff, 18414 S. Wilton Place, Torrance, Calif. 90504

[21] Appl. No.: 455,618

[22] Filed: Mar. 28, 1974

Related U.S. Application Data

[63] Continuation-in-part of Ser. No. 323,278, Jan. 10, 1973, Pat. No. 3,852,934.

[51] Int. Cl.² ..... E04D 1/28

[52] U.S. Cl. ..... 52/309.8; 52/313; 52/314; 52/527; 52/536; 52/540; 52/542; 52/555; 52/560

[58] Field of Search ..... 52/309, 313, 314, 523, 52/519, 524, 525, 560, 527, 536, 537, 540, 542, 554, 555, 543

[56] References Cited

U.S. PATENT DOCUMENTS

| | | | |
|---|---|---|---|
| 492,736 | 2/1893 | Shull | 52/539 |
| 638,802 | 12/1899 | Donaldson | 52/542 |
| 1,926,257 | 9/1933 | Bawterheimer | 52/314 X |
| 2,362,236 | 11/1944 | Bassler | 52/521 |
| 2,578,085 | 12/1951 | Perkins | 52/313 X |
| 3,262,239 | 7/1966 | Mills | 52/540 |
| 3,362,120 | 1/1968 | Warren | 52/309 |
| 3,593,479 | 7/1971 | Hints et al. | 52/555 X |
| 3,626,439 | 12/1971 | Kreisel | 52/539 X |
| 3,740,914 | 6/1973 | Diez | 52/536 X |
| 3,760,546 | 9/1973 | Martin et al. | 52/555 |
| 3,841,050 | 10/1974 | Martin | 52/555 |

FOREIGN PATENT DOCUMENTS

| | | | |
|---|---|---|---|
| 1,369,567 | 7/1964 | France | 52/539 |

*Primary Examiner*—Leslie Braun
*Attorney, Agent, or Firm*—Don B. Finkelstein

[57] ABSTRACT

An integrated shingle construction in which shingles are constructed perferably of foamed plastic primarily, the construction being in the form of panels in which the foamed plastic shingle is integrated with a board or wooden roofing member such as a standard sized sheeting member that attaches directly to the rafters. The integrated shingle and sheeting members are applied in courses to a pitched roof, for example, the first course being at the top or adjacent the ridge pole and then proceeding downwardly to the eves. Adjacent courses are in interlocking sealing interconnection. The integrated shingle and sheeting members are formed in extended panels with the shingle portion simulating a plurality of individual shingles. Sealing and interconnecting or joining means are provided to sealingly join panel courses at their ends.

4 Claims, 9 Drawing Figures

INTERLOCKING COMBINATION SHINGLE AND SHEETING ARRANGEMENT

This application is a continuation-in-part of application Ser. No. 323,278 filed Jan. 10, 1973, having the same inventorship and ownership. The technology of the parent application is hereby incorporated herein for reference.

BACKGROUND OF THE INVENTION

1. Field of the Invention

This invention relates to the roofing and siding art and more particularly to improved interlocking simulated shingle construction.

2. Description of the Prior Art

The conventional types of shingles, such as wood, concrete or clay tiles or asphalt, have generally not proven to be completely satisfactory in all applications. In general, the comparatively small size of the individual conventional shingles requires a comparatively lengthy time for covering an entire roof or wall. Further, such shingles require periodic maintenance in order to maintain them in satisfactory condition. These shingles, of course, have not proven to be effective thermal insulators and normally some other form of packing or insulation material has been utilized in the roof, ceiling or wall structure to provide the necessary thermal insulation.

Therefore, there have heretofore been developed various types of simulated shingles attemtping to solve these problems. For example, conventional wood shingles were utilized on metallic carriers, such as those shown in U.S. Pat. Nos. 3,418,777 and 3,232,020. Such arrangements often require separate elements, such as clips or the like, for complete installation. Utilization of such metallic carriers for holding conventional shingles did little to either decrease the cost of installing a shingle roof or improve the thermal or structural integrity of the shingles.

Other types of roofing or siding structures have incorporated various plastic laminates combined with one or more ridged members for installation as a simulated shingle on roofs or on walls as sidings. In certain of these prior art simulated shingle arrangements the nail heads were exposed to the environment thereby requiring utilization of corrosive resistant steel, or other similar materials resistant to environmental effects, in order to avoid rusting or the like. One such arrangement is shown in U.S. Pat. No. 2,352,236. Such exposed nails or screws detracted from the true simulated shingle structural appearance of the roof or wall. Other U.S. Patents, such as U.S. Pat. Nos. 3,626,439; 3,605,369; 638,802; 3,111,787 and 2,110,579 show various shingle arrangements.

In other simulated shingles the utilization of metallic elements not only increased the cost but required cutting tools, generally not available to the roofer, for sizing the simulated shingle elements to the particular roof or wall being covered. Thus, special saws or shears were required to cut through such metallic elements. Additionally, in utilization of metallic elements the weight of the load on the roof was thereby increased thus increasing the required strength of the supporting structure.

Further, the lower edge of most prior art shingles rested on the top edge of the adjacent course of shingles leaving a void between the sheeting and the shingles, thus resulting in fractures of the shingles and increased fire hazard.

One type of simulated shingle heretofore sold by National Pacific Roofing Products, a Division of Stephan Chemical Company, 8748 Remmet Avenue, Canoga Park California, utilized fiberglass shingle panels which were heavy, expensive and difficult to trim to size and then install in the field. Further, while providing a water tight seal between adacent shingles in the same course, such a seal was not interlocked between adjacent courses resulting often in wind forces loosening an entire panel.

While certain of the prior art simulated shingles have utilized various forms of interlock between simulated shingles in adjacent courses, such interlocks have generally not been of the type allowing a rapid slide fit of one course into the immediately previously installed course. Further, there has been no provision, in general, in prior art simulated shingles for a water tight sealing interlock between adjacent shingles in the same course. In the patent application referred to above a unique improved interlocking shingle construction is provided for simulating a plurality of shingles of foamed plastic and having wood portions and are secured to the sheeting members of a roof. The construction of the herein application is entirely new and unique in that while utilizing, in part, the principle of the prior application, the panels or courses of shingle members made of plastic are now integrated to the boards or wooden members that constitute the sheeting itself of the roof so that in making the construction, that is applying the roof, the shingles are integrated with the sheeting members and become applied at the same time to the roof rafters and are in sealed interlocking relationship both as between parallel courses from the top or ridge pole to the eves. Also, where courses or panels are joined at their lateral ends, they are also sealed. A preferred form of the construction is described in detail hereinafter.

SUMMARY OF THE INVENTION

It is a primary object of the invention to provide an improved integrated shingle and sheeting construction comprised of integrated panels or courses made up of foamed plastic shingle members bonded to a sheeting member or board which is securable to the rafters of a pitched roof.

It is a further object to provide such an improved integrated roof member wherein sealed interlocking relationship is provided between adjacent courses or panel members.

It is another object to provide integrated members as described which are directly attachable in any suitable way on building members such as rafters whereby the roof is completed.

It is a further object to provide a roof contruction as described which is rapidly and easily constructed or installed without special tools or other implements.

It is a further object to realize an integrated product as described which eliminates the need for having separate sheeting members and shingle members to be applied separately and further to provide an integrated product which is extremely inexpensive, easy to fabricate and economical to produce and install or utilize.

These and other objects of the invention are realized in a preferred embodiment as described in detail hereinafter.

In the preferred form the integrated roof member is in the form of an elongated body member preferably molded of a foamed plastic such as polyurethane foam, the body member having upper and lower surfaces, a forward or front surface, a rear surface and a pair of side surfaces similar to these parts of the shingle member of the prior application. The surfaces may be textured to simulate the appearance of shake shingles, or other external roof constructions. The body member of the integrated roof member may be provided with indentations in a spaced relationship to simulate, if desired, known sizes of shingles. In the preferred construction the product is formed from the molded foamed plastic and is bonded directly to the wooden sheeting member normally utilized for constructing a roof. Exposed parts of the foamed plastic are coated with weather proofing coating as described more in detail hereinafter.

Adjacent courses are constructed to have interlocking dovetail or tongue and groove relationship to provide complete sealing along the elongated length thereof as well as on the ends. The courses are formed in panels of various lengths which may be the length of the sheeting member normally nailed to the rafters of a pitched roof.

The integrated members interlock together as described thus simulating shingles, such as shake shingles, from the external view thereof and, as stated, the entire integrated member is nailed directly to the rafters, or to the joists or studs forming the siding of a wall and the attachment or securement can be by way of nails or other suitable securing or bonding means. When the plastic part of the integrated body member is fabricated from a polyurethane foam suitable exterior coating is applied thereon to prevent environmental deterioration due to exposure of the polyurethane foam to the ultraviolate radiation contained in sunlight. All exposed surfaces may be suitably coated with a protective coating during the manufacture of the integrated roof member in accordance with the herein invention. Where it is necessary to trim the integrated roof member to fit a particular installation, the exposed edges may be quickly and easily coated at the job site.

BRIEF DESCRIPTION OF THE DRAWINGS

Further objects and additional advantages of the invention will become apparent from the following detailed description and annexed drawings wherein.

DESCRIPTION OF THE PREFERRED EMBODIMENT

Figure 1:
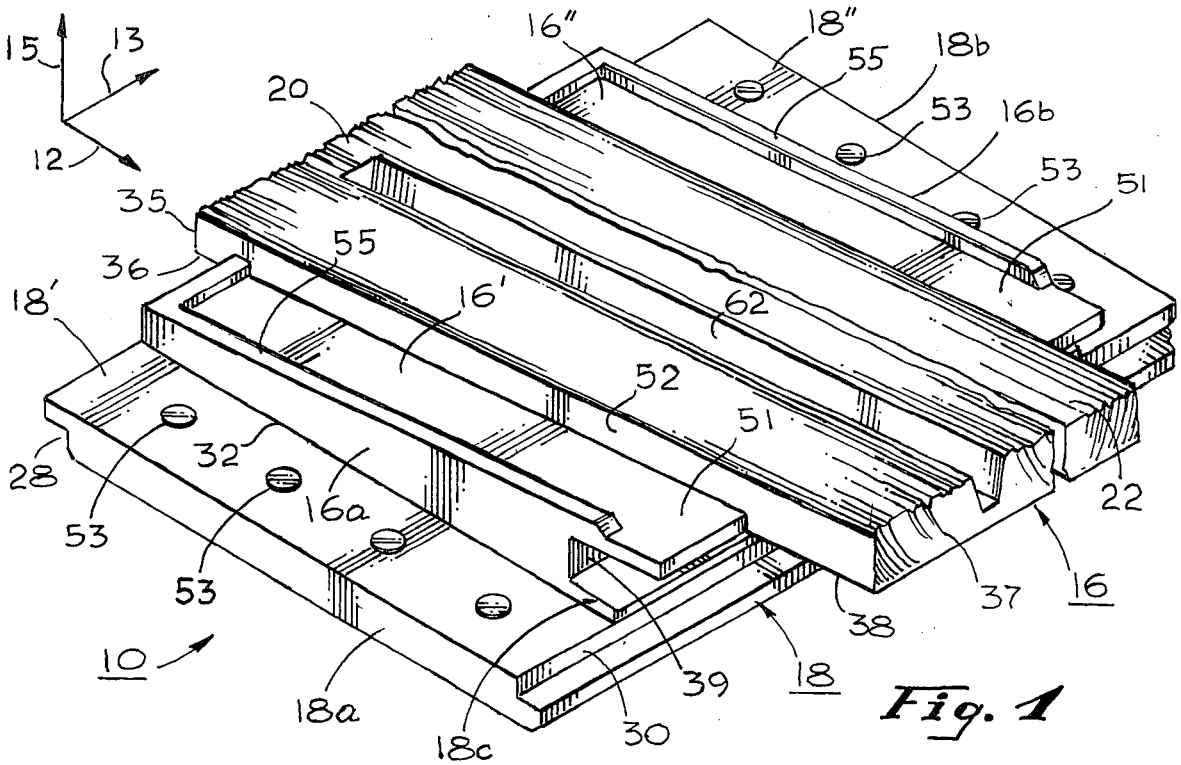
FIG. 1 is a perspective view of a section of a preferred form of one of the integrated roofing products.

Referring now to the various figures of the drawings there is illustrated more particularly in FIG. 1 a perspective view of one embodiment of the integrated element or member of the invention generally designated at 10. As shown in the figures this embodiment is an integrated shingle or roofing product which in appearance simulates a shake shingle and has a slant width in the direction of the arrow 12 approximately equivalent to the exposed slant width of a single conventional wood shake shingle as installed. However the slant width may be made to simulate any desired number of shingles. Similarly, the lateral width in the direction of the arrow 13 may be made to simulate any desired number of adjacent shingles in the same course, the lateral width being the elongated dimension of the sheeting member 18. (The term slant width is used to identify the dimension in the direction from the ridge pole to the eves. The arrow 15 identifies the thickness dimension. The top end 20 is the end towards the ridge pole and the bottom end 22 is the end towards the eves. The lateral width identifies the dimension in the direction of the arrow 13 although this dimension may also be identified as length since the integrated product is constructed in panels of desired length.)

Figure 2:
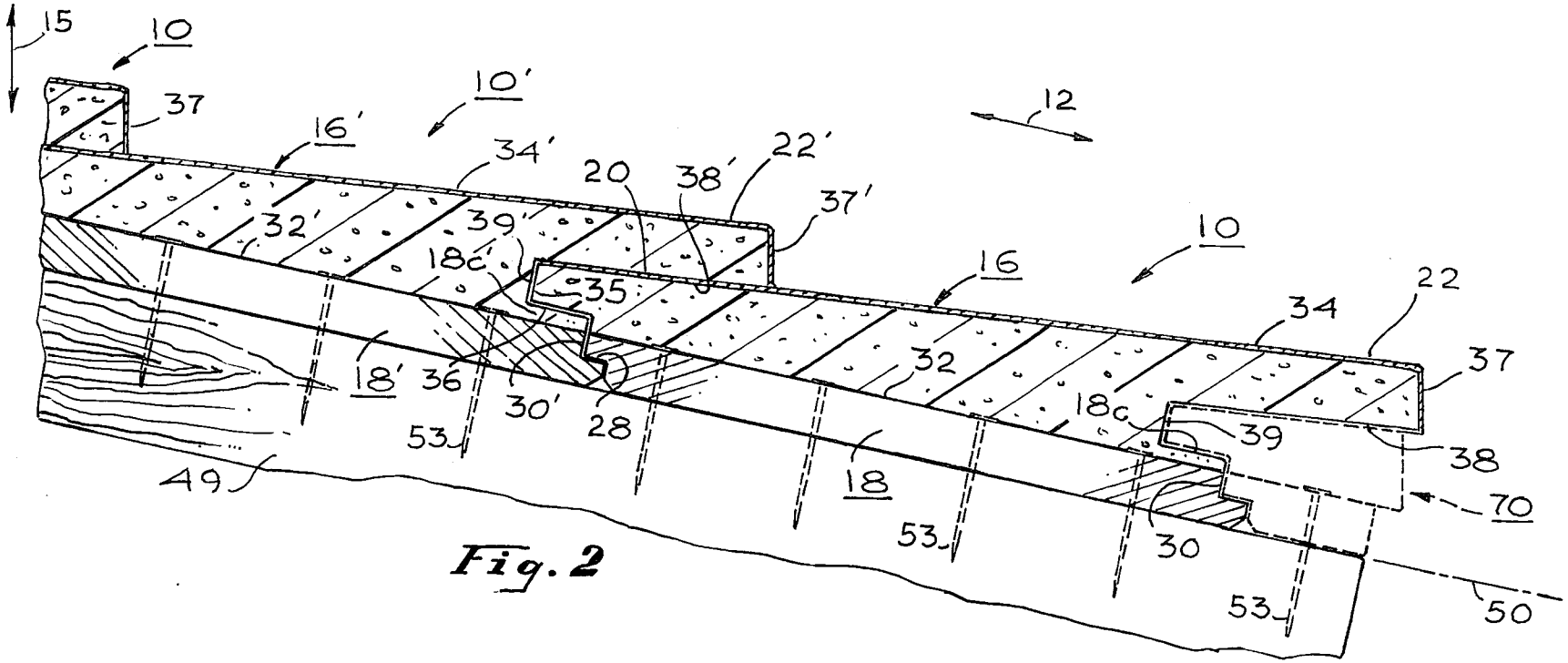
FIG. 2 is a sectional view in the direction from ridge pole towards the eves of adjacent integrated roofing or shingle products in assembled interlocking relationship on a roof.

As may be seen in the drawings each of the integrated panel elements or members comprises a foamed plastic layer or panel that is designated at 16 which is secured by bonding to a wooden sheeting member or board 18, these parts having a configuration as may be seen in the sectional view of FIG. 2. As explained the product may be constructed in the form of elongated panels and in the drawings the top end of the panel is designated at 20 as may be seen in FIG. 4, the bottom end is designated at 22 as may be seen in FIG. 5.

Figure 3:
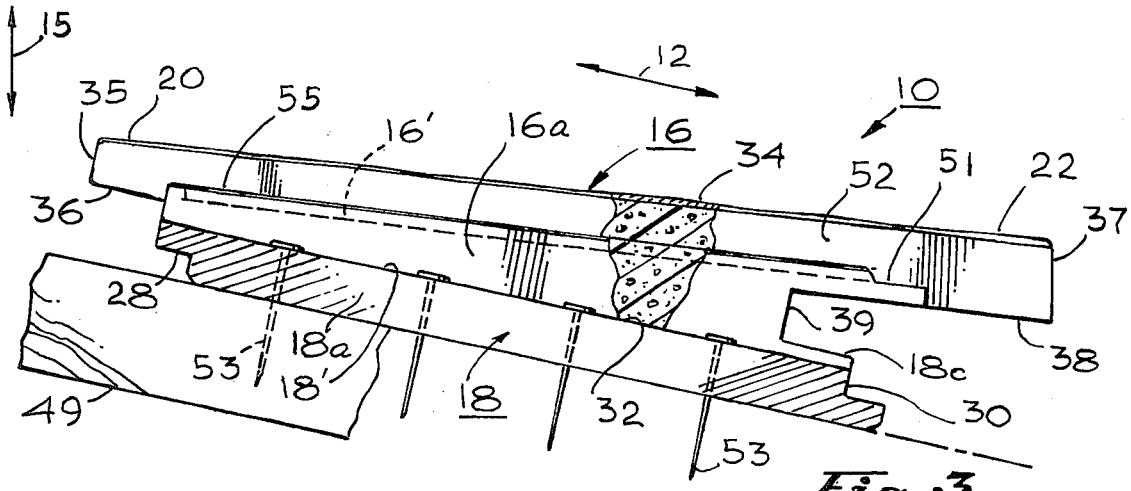
FIG. 3 is a "side" view of one of the integrated products, that is a view at the end of one of the panels.

The sheeting member 18 which attaches to the rafters of the building or the side members, that is the studs, is of well known design and is a flat member as shown which at the upper forward side 20 is cut away to form a shoulder shown at 28 and is cut away to form a shoulder at the lower side as designated at 30. The foamed plastic element 16 is bonded to the sheeting member 18 along the surface thereof as designated at 32. The foamed plastic element has a cross-sectional configuration as shown in FIGS. 2 and 3 having a slanted upper surface 34, top end surface 35 having an undercut 36 as shown and having a bottom end surface 37 with an undercut 38 providing a further surface 39 to define a lower overhang or tongue as shown. FIG. 2 illustrates the application of the integrated members to the rafters 49 of a pitched roof, and the line 50 designating the angle or line of the rafters to which the integrated roof members can be attached in any suitable manner such as by nails 53, or by bonding or otherwise. The nails 53 are driven through the end portions 18' and 18'' of the sheeting 18 (as shown in FIG. 1) and into the rafters 49. Thus, the preferred lateral width in the direction of the arrow 13 of each panel 10 is the rafter 49 spacing, or an even multiple thereof. For example, the panels 10 may be 8 ft., 10 ft., 12 ft., or the like, depending on rafter spacing. The edges **18*a* and 18*b* may be positioned along the center line of the rafters to allow the next adjacent panel to be similarly positioned. The nails 53 are driven only through the sheeting 18 and not through the plastic layer 16 thus avoiding damage to the plastic layer 16** which could lead to environmental deterioration, loss of waterproofing, or the like.

The end portions 18' and 18'' of adjacent panels 10 are covered and sealingly interconnected by a separate member, as described below in connection with FIGS. 6, 7, 8, and 9. Since the nails 53 are thus covered, no rust streaks or the like will occur.

FIG. 1, which is a perspective view, shows the top surface of one of the integrated panels illustrating the configuration of the end parts of one of the panels 10 according to the present invention showing the plastic layer 16 as bonded to the sheeting member 18. As may be seen, the sheeting member 18 in FIG. 1 extends beyond the lateral end walls **16*a* and 16*b* of the foamed plastic element 16 to form the end portions 18' and 18''**, respectively.

The plastic layer 16 is provided at each end of the panel 10 with substantially identical lateral end sealing means 16' and 16'' as shown in FIG. 1. Numeral 52 designates a lateral end surface; numeral 51 designates a top surface; and numeral 55 an upstanding sealing ridge. The lateral end sealing means 16' and 16'' as well as end portions 18' and 18'' are covered by the connecting structure as described below. All exposed surfaces of foamed plastic are coated with a suitable coating to protect from ultraviolet rays and/or other environmental conditions as described.

Figure 4:
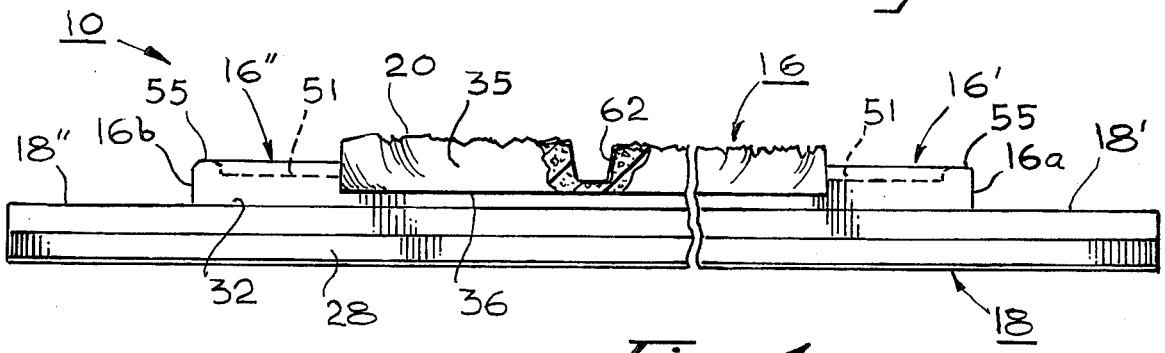
FIG. 4 is a view of the upper side, that is the forward side towards the ridge pole of a section of one of the integrated panels.

To simulate a shake shingle, the foamed plastic 16 may be separated, that is provided with grooves running in the slant direction, on the upper surface 34 of the shingle simulating section 16'' of the foam plastic layer 16, one of which is designated at 62 in FIGS. 1 and 4. The grooves may be of any desired cross-sectional shape, either rectilinear or wedge shaped as shown, and spaced apart throughout the width of the panel 10 in approximately one shingle spacing.

FIG. 2 shows a sectional view of the integrated members 10 and 10' in interlocking sealing relationship on a rafter 49 of a roof. It may be seen that the juncture or joint between panels in adjacent courses of integrated members is a tongue in groove type joint whereby effective sealing and waterproofing is realized. This type of joint is described in greater detail in the above-identified co-pending patent application. Shoulders 28 and 30' of the sheeting elements come together in the conventional abutment position of such sheeting members, as shown, whereas the overhang defined by topend surface 35 and undercut 36 of the foamed plastic part 16 of the member 10 overlaps into the space between bottom end surface 37' and undercut 38' and sheeting portion **18*c*' of panel 10'**.

Figure 5:
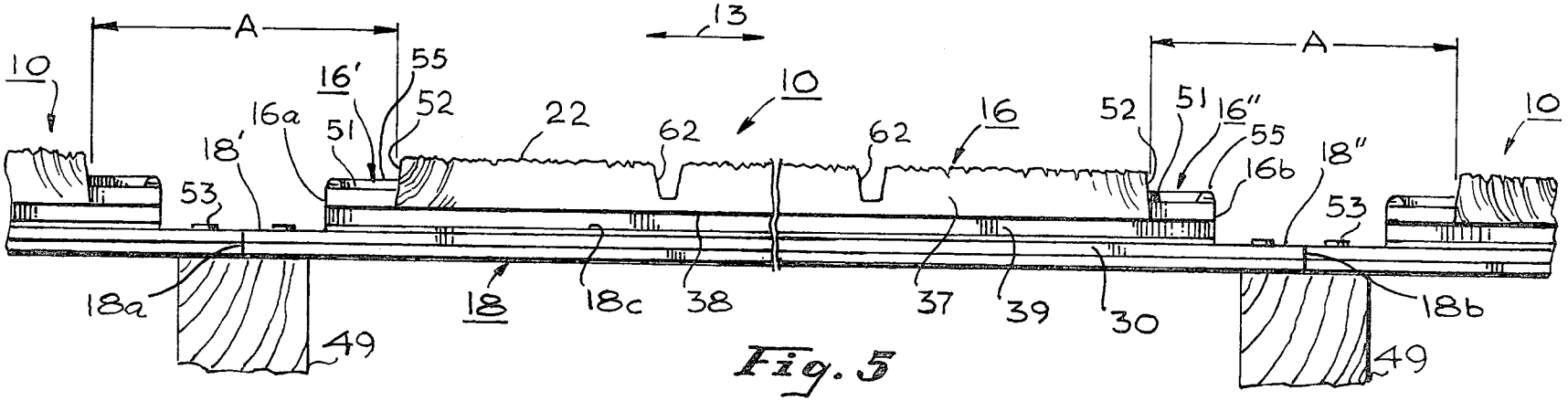
FIG. 5 is a view of the lower side of two of the integrated panels as installed on a roof.

At the position of the eves preferably a starting member 70 may be provided, as in the parent application, and is shown in broken lines in FIG. 2. This starting member may be fabricated similarly to the panels 10 in the same lengths and may be directly attached to the rafters of the roof in the same manner as the panels 10. Starting member 70 has a cross-sectional configuration as shown having shoulders which interfit with the lower end 37 shoulder 39 of the plastic element 16 and the shoulder 30 of the wood member 18 and the overhang or lower surface 38 of the plastic member 16. As previously described the integrated members 10 may be constructed in elongated courses or panels of predetermined length which may have a configuration at each end as illustrated in FIG. 1. FIG. 5 illustrates the positioning of two adjacent panels 10 and 10' prior to the installation of the connecting member described in FIGS. 6 through 9.

As shown in FIG. 5 the panels 10 and 10' are nailed to the rafters 49 with the edges **18*a* and 18*b* at the center thereof. The spacing "A" between the walls 16*a* and 16*b* and the corresponding walls of the adjacent panels 10' is approximately the lateral length of a single shingle. As described below, the connecting member is positioned between the panels 10 and 10' to provide a sealing relationship therewith. The spacing "A" is slightly greater, in preferred embodiments than the lateral length of a shingle to allow a space between each connecting member and the walls 52** to simulate the spacing between shingles.

Preferred coatings for the foamed polyurethane that may be exposed to sunlight may be coatings such a polyester, adhesive, aggregate mixture, polyvinyl chloride, polyetheylene, vinyl weather resistant coating or the like. These coatings may be applied at the forming of the integrated product and also may be quickly applied at the job site during installation on exposed portion that may be cut in providing coverage on a given size roof. If desired, the striations and grooves may be provided in order to closely simulate the appearance of shake shingles. This appearance is accentuated by desirable positioning of the grooves 62.

It will be observed, of course, that the integrated product is tapered in the thickness direction designated by the arrow 15 in FIG. 1. The foamed plastic element 16 is in contact with and bonded to the wooden member 18 throughout the areas of contact therebetween. In the construction as shown in FIG. 2 wherein the integrared members are applied to a pitched roof building having a ridge pole or peak, a ridge construction member (not shown) may be provided similar to that of the above identified co-pending patent application.

Figure 6:
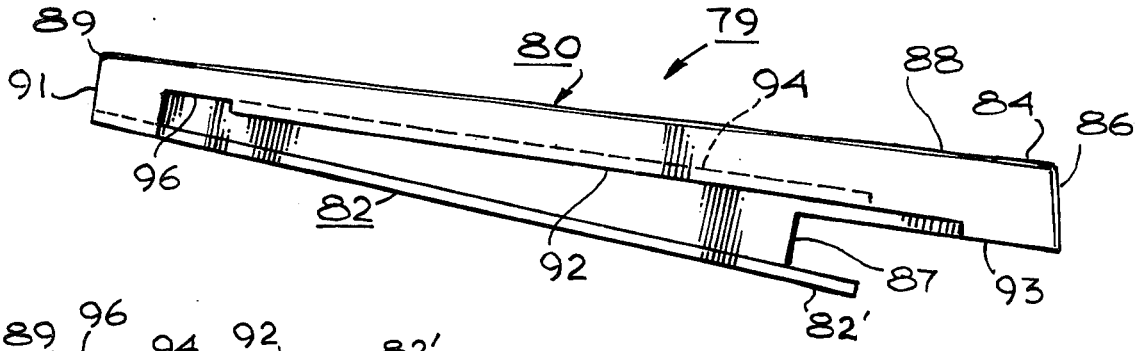
FIG. 6 is a side view of a preferred form of joining shingle product for purposes of providing joint between adjacent sides of shingle products of the type described in FIGS. 1 through 5.

In the structure as described and as illustrated in FIG. 5 as can be seen, side parts of the panels are constructed substantially identical, and in preferred embodiments, all shingle product panels are constructed alike, that is, being uniform with the configuration at the sides being the same. For purposes of joining and sealing the panels, a separate joining shingle is provided to form the joint between adjacent shingles. Such a joining product is illustrated in FIGS. 6, 7, 8 and 9. FIG. 6 shows a preferred cross-sectional configuration of such a connecting member or joining product generally designated 79 that can be used.

In the construction of the connecting member 79 in FIGS. 6 through 9 the foamed plastic part of the article is designated at 80 and in this product on the underside there is a relatively thin layer of wood, hardboard, plastic, or other rigid material such as the wood plate designated at 82. As in the previous embodiments the exterior of the foamed plastic is coated with an appropriate coating material as designated at 84. The bottom edge 86 is aligned with the edges 37 of the panels 10 when installed and the forward portion 88 overlaps the forward end 20 of the panel 10 in the next course, the projecting portion 82' of the wood plate 82 underlying the undercut 36 thereof to provide an interlocking connection therebetween. The wall 87 abuts the wall 35 of the panel 10 in the next course towards the eves and the top end 89 underlies the surface 38 of the lower portion 22 of the panel 10 in the next course towards the ridge pole with the surface 91 abutting the surface 39 thereof.

Figure 7:
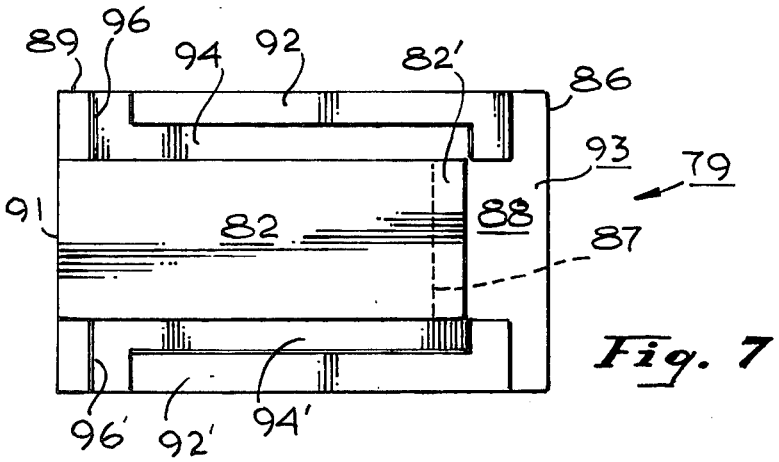
FIG. 7 is a view of the bottom side of the joining product of FIG. 6.
Figure 8:
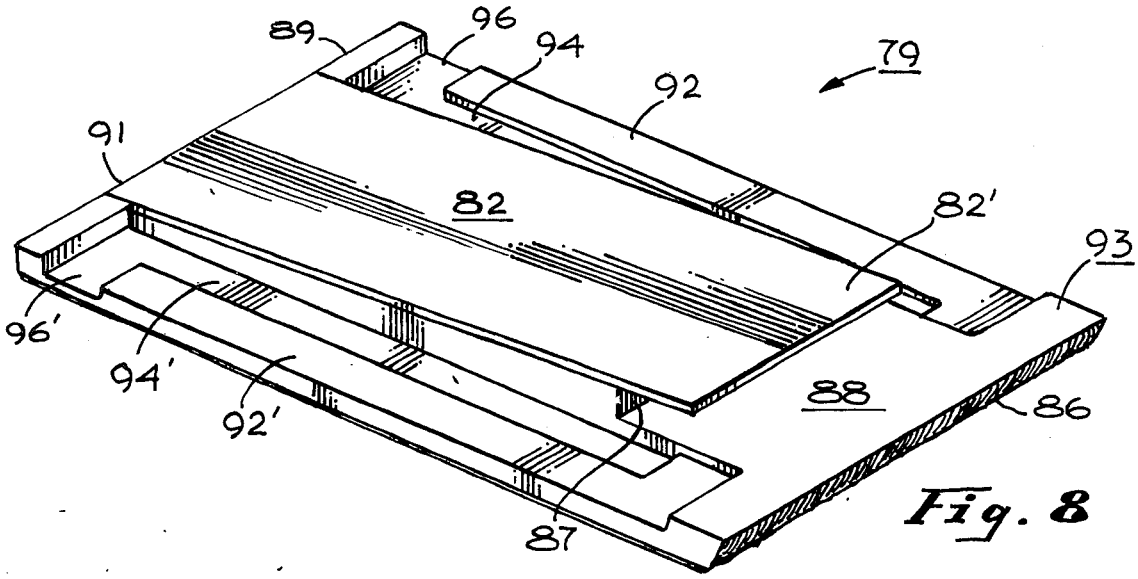
FIG. 8 is an isometric view primarily of the bottom side of the product of FIGS. 6 and 7.

On the bottom side 93 of the connecting member 79, as shown in FIG. 7 there are formed shallow depressions extending lengthwise of the product as designated at 92 and 92' and then inwardly of these depressions are deeper straight sided depressions as designated at 94 and 94' which have lateral parts as designated at 96 and 96'.

Figure 9:
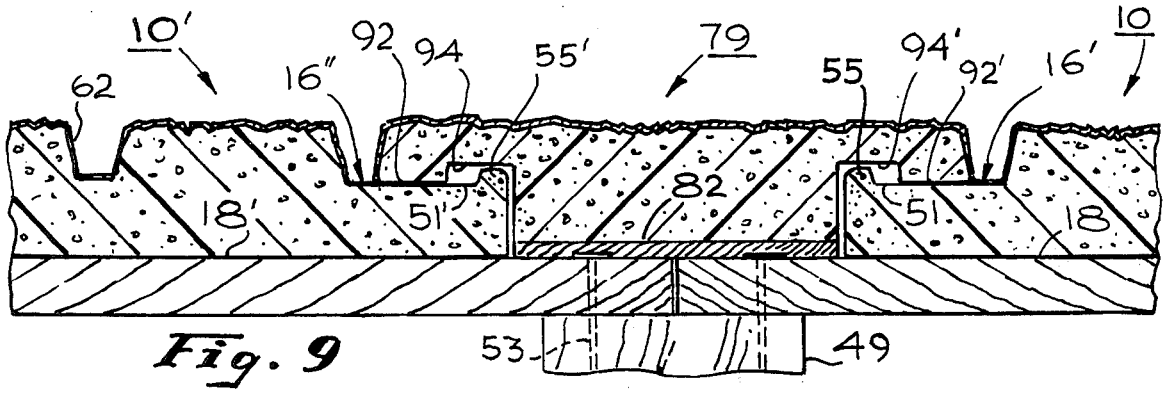
FIG. 9 is a sectional view illustrating the joining of two panels of the type shown in FIGS. 1–5 joined together by the joining shingle of FIGS. 6–8.

FIG. 9 is a sectional view illustrating how the product of FIGS. 6 through 9 is adapted to join between the side edges of adjacent panels 10 and 10' as shown in FIG. 5, the adjacent panels being identical and each individual one have the same constructional configuration along both sides or side edges.

FIG. 9 shows panels 10 and 10' adapted to form a joint with the connecting member 79 of FIGS. 6 to 9. The transverse extending portion of the ridges 55 and 55' extend into depressions 94 and 94' and the laterally extending portions thereof extend into lateral parts 96 and 96'. The shallower depressions 92 and 92' overlay the surfaces 51 and 51' to effect a weaterproof joining therebetween. While the connecting member 79 is firmly retained by the panels 10 in the adjacent courses, nails may be utilized to secure the member 79 by nailing in the portion 89.

From the foregoing it can be seen that all of the products of the type illustrated in FIGS. 1 through 5 can be constructed to be exactly alike and where it may be necessary to make lateral joints, joints can be made by way of the product as described in FIGS. 6 through 9.

The foregoing disclosure is representative of a preferred form of the invention and is to be interpreted in illustrative rather than a limiting sense the invention to be accorded the full scope of the claims appended thereto.

I claim:

1. A composite integrated building construction member for installation on roofs, walls and other elements and comprising in combination:

an elongated construction member having top and bottom surfaces and sides and comprising a first part formed from foamed plastic material simulating a shingle and a second part comprised of a wooden sheeting member, said first part and second part being integrally bonded together throughout the elongated length thereof whereby to form a single integrated construction element adapted for securement on roofs, walls or otherwise of construction, and having lateral end sealing means along lateral edges for sealing engagement with adjacent construction members in the same course, and said lateral end sealing means comprising at least one angular shoulder one upstanding ridge and at least one extending overhang so configured that said lateral edges of adjacent composite members are adapted to be brought into juxtaposed sealing interfitting relationship; and end sealing means for sealing engagement with construction members in adjacent courses; said lateral end sealing means comprising a first end sealing means spaced a first preselected distance from a first end of said wooden sheeting member and a second end sealing means spaced a second preselected distance from the second end of said sheeting member, and said sheeting member free of said foam plastic material in said first and said second preselected distances to provide a securing area thereof in which securing members may be driven therethrough for said securement thereof.

2. An elongated construction member as in claim 1 wherein said member has responding angular shoulders, upstanding ridges and extending overhang at both lateral edges whereby all members can be constructed alike and they are adapted for being joined laterally by a joining member.

3. A composite integrated building construction member for installation on roofs, walls and other elements and comprising in combination:

an elongated construction member having top and bottom surfaces and sides and comprising a first part formed from foamed plastic material simulating a shingle and a second part comprised of a wooden sheeting member, said first part and second part being integrally bonded together throughout the elongated length thereof whereby to form a single integrated construction element adapted for securement on roofs, walls or otherwise of construction, and having lateral end sealing means along lateral edges for sealing engagement with adjacent construction members in the same course, and sealing means for sealing engagement with construction members in adjacent courses; said lateral end sealing means comprising a first end sealing means spaced a first preselected distance from a first end of said wooden sheeting member and a second end sealing means spaced a second preselected distance from the second end of said sheeting member, and said lateral end sealing means are constructed to have the same configuration on both said first end sealing means and said second end sealing means of the construction member and each of said first and second end sealing means comprising angular shoulders and upstanding ridges, whereby all members are identical and are adapted to be joined laterally with a joining member, and said sheeting member free of said foam plastic material in said first and said second preselected distances to provide a securing area thereof in which securing members may be driven therethrough for said securement thereof; and a joining shingle member adapted for forming a joint between said lateral edges of adjacent construction members, said joining member having at each side an overhang and a groove adapted to engage in sealing tongue and groove relationship with the angular shoulders and upstanding ridges at the lateral edges of said construction member.

4. A construction as in claim 3 wherein the joining member comprises an upper layer of foam plastic material bonded to a lower rigid panel the joining member being composited and having thickness and taper corresponding to that of said construction member.

* * * * *